US012339005B2

(12) United States Patent
McCaldon

(10) Patent No.: US 12,339,005 B2
(45) Date of Patent: Jun. 24, 2025

(54) HYDROGEN FUEL DISTRIBUTOR

(71) Applicant: Pratt & Whitney Canada Corp., Longueuil (CA)

(72) Inventor: Kian McCaldon, Orangeville (CA)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 18/163,369

(22) Filed: Feb. 2, 2023

(65) Prior Publication Data

US 2024/0263791 A1 Aug. 8, 2024

(51) Int. Cl.

| | |
|---|---|
| ***F23R 3/28*** | (2006.01) |
| ***F23D 14/82*** | (2006.01) |
| ***F23R 3/04*** | (2006.01) |
| ***F23R 3/14*** | (2006.01) |

(52) U.S. Cl.

CPC ..... *F23R 3/286* (2013.01); *F23D 14/82* (2013.01); *F23R 3/045* (2013.01); *F23R 3/14* (2013.01)

(58) Field of Classification Search

CPC .... F23R 3/286; F23R 3/14; F23R 3/36; F02C 3/22

See application file for complete search history.

(56) References Cited

U.S. PATENT DOCUMENTS

| | | | |
|---|---|---|---|
| 4,982,570 | A | 1/1991 | Waslo et al. |
| 5,613,363 | A | 3/1997 | Joshi et al. |
| 6,786,047 | B2 | 9/2004 | Bland et al. |
| 7,832,212 | B2 | 11/2010 | Bunker |
| 7,870,736 | B2 | 1/2011 | Homitz et al. |
| 8,266,911 | B2 | 9/2012 | Evulet |
| 8,413,445 | B2 | 4/2013 | Poyyapakkam |
| 8,539,773 | B2 | 9/2013 | Ziminsky et al. |
| 8,661,779 | B2 | 3/2014 | Laster et al. |
| 8,893,500 | B2 | 11/2014 | Oskam |
| 9,771,869 | B2 | 9/2017 | Li et al. |
| 9,976,522 | B2 | 5/2018 | Patel et al. |
| 10,082,294 | B2 | 9/2018 | Laster et al. |

(Continued)

FOREIGN PATENT DOCUMENTS

| | | |
|---|---|---|
| CN | 101220955 | 7/2008 |
| CN | 206113000 | 4/2017 |

(Continued)

OTHER PUBLICATIONS

Extended European Search Report for European Application No. 24154531.8 mailed May 28, 2024.

*Primary Examiner* — Katheryn A Malatek

(74) *Attorney, Agent, or Firm* — Carlson, Gaskey & Olds, P.C.

(57) ABSTRACT

A fuel mixture distribution system for a turbine engine assembly includes a combustor that includes a wall that defines a combustion chamber, a fuel mixture distributor that includes an air conduit that defines a mixing chamber that extends through the wall along between an inlet to an exit opening to the combustion chamber, the air conduit shape is defined to achieve the desired mixing and prevent flashback at all operating conditions, and a fuel distributor extends into the mixing chamber at a location upstream of the exit opening. The fuel distributor includes a plurality of fuel openings where a fuel flow is communicated and mixed with an airflow passing through the mixing chamber.

15 Claims, 8 Drawing Sheets

(56) References Cited

U.S. PATENT DOCUMENTS

| | | | | |
|---|---|---|---|---|
| 10,267,522 | B2 | 4/2019 | Ciani et al. | |
| 10,502,425 | B2 | 12/2019 | Boardman et al. | |
| 10,704,786 | B2 | 7/2020 | Laster et al. | |
| 10,865,989 | B2 | 12/2020 | Sadasivuni | |
| 10,941,940 | B2 | 3/2021 | Bulat et al. | |
| 11,054,140 | B2 | 7/2021 | Choi et al. | |
| 11,067,280 | B2 | 7/2021 | Boardman et al. | |
| 2002/0192615 | A1* | 12/2002 | Moriya | F23D 14/02 431/278 |
| 2005/0081508 | A1 | 4/2005 | Edelman et al. | |
| 2011/0000214 | A1* | 1/2011 | Helmick | F23R 3/14 60/734 |
| 2011/0185703 | A1 | 8/2011 | Dodo et al. | |
| 2012/0227411 | A1 | 9/2012 | Carroni et al. | |
| 2013/0086910 | A1 | 4/2013 | Khan et al. | |
| 2014/0096502 | A1 | 4/2014 | Karlsson et al. | |
| 2017/0227224 | A1 | 8/2017 | Oskam et al. | |
| 2017/0307210 | A1 | 10/2017 | Hirano et al. | |
| 2021/0172413 | A1 | 6/2021 | Snyder | |
| 2022/0290862 | A1 | 9/2022 | Kediya et al. | |

FOREIGN PATENT DOCUMENTS

| | | |
|---|---|---|
| EP | 1923637 | 5/2008 |
| JP | 2013108667 | 6/2013 |
| JP | 5538113 | 7/2014 |
| JP | 5926635 | 5/2016 |
| WO | 2016051756 | 4/2016 |
| WO | 2020259918 A1 | 12/2020 |
| WO | 2020259919 | 12/2020 |

* cited by examiner

HYDROGEN FUEL DISTRIBUTOR

BACKGROUND

A gas turbine engine ignites a mixture of compressed air with fuel in a combustor to generate a high temperature exhaust gas flow. The exhaust gas flow expands through a turbine to generate shaft power that is utilized to drive a propulsor and engine accessory components. Conventional hydrocarbon fuels are introduced into a combustor in a liquid form. The liquid fuel is atomized to induce mixing with the compressed airflow. Alternate, non-carbon based fuels such as hydrogen perform differently during combustion and therefore unconventional combustor/fuel injection arrangements are necessary to ensure a stable combustion process which delivers the desired turbine inlet temperature pattern, starting and durability while minimizing emissions. At the same time, in order to convert an existing engine design to use alternate fuels it is highly desirable to maintain the existing combustor dimensions. This is particularly important in aviation gas turbine engines, as increases in engine size or weight will have consequences for aircraft design.

Aircraft engine manufacturers continue to seek further improvements to engine performance including improvements to durability, emissions and propulsive efficiencies.

SUMMARY

A fuel mixture distribution system for a turbine engine assembly according to an exemplary embodiment of this disclosure, among other possible things includes a combustor that includes a wall that defines a combustion chamber, a fuel mixture distributor that includes an air conduit that defines a mixing chamber extending between an inlet and an exit opening to the combustion chamber, the air conduit shape is defined to achieve the desired mixing and prevent flashback at all operating conditions, and a fuel distributor extends into the mixing chamber at a location upstream of the exit opening. The fuel distributor includes a plurality of fuel openings where a fuel flow is communicated and mixed with an airflow passing through the mixing chamber.

A combustor for a turbine engine according to another exemplary embodiment of this disclosure, among other possible things includes a combustor wall that defines a combustion chamber, and at least one fuel mixture distributor that is disposed at an end of the combustion chamber. The fuel mixture distributor includes an air conduit that defines a mixing chamber that extends between an inlet and an exit opening to the combustion chamber. The air conduit shape is defined to achieve the desired mixing and prevent flashback at all operating conditions. The combustor for a turbine engine further includes a fuel distributor that extends into the mixing chamber at a location upstream of the exit opening. The fuel distributor includes a plurality of fuel openings where a fuel flow is communicated and mixed with air in the mixing chamber, and a secondary air inlet where a secondary airflow is introduced into the air conduit proximate the exit opening induces swirling component into a fuel air mixture that is communicated into the combustion chamber.

A turbine engine assembly according to an exemplary embodiment of this disclosure, among other possible things includes a compressor section and turbine section that are disposed in flow series along an engine longitudinal axis, a combustor that is disposed between the compressor section and turbine section, the combustor includes walls that define a combustion chamber, at least one fuel mixture distributor that is disposed at an end of the combustion chamber, the fuel mixture distributor includes an air conduit that defines a mixing chamber that extends through the wall along an axis between an inlet to an exit opening to the combustion chamber, the air conduit shape being defined to achieve the desired mixing and prevent flashback at all operating conditions. A fuel distributor extends into the mixing chamber at a location before the exit, the fuel distributor includes a plurality of fuel openings where a fuel flow is communicated to a central region within the mixing chamber, and a secondary air inlet where a secondary airflow is introduced into the air conduit proximate the exit opening induces swirling component into a fuel air mixture that is communicated into the combustion chamber, and a fuel system that communicates a hydrogen fuel in a gaseous phase to the fuel mixture distributor.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
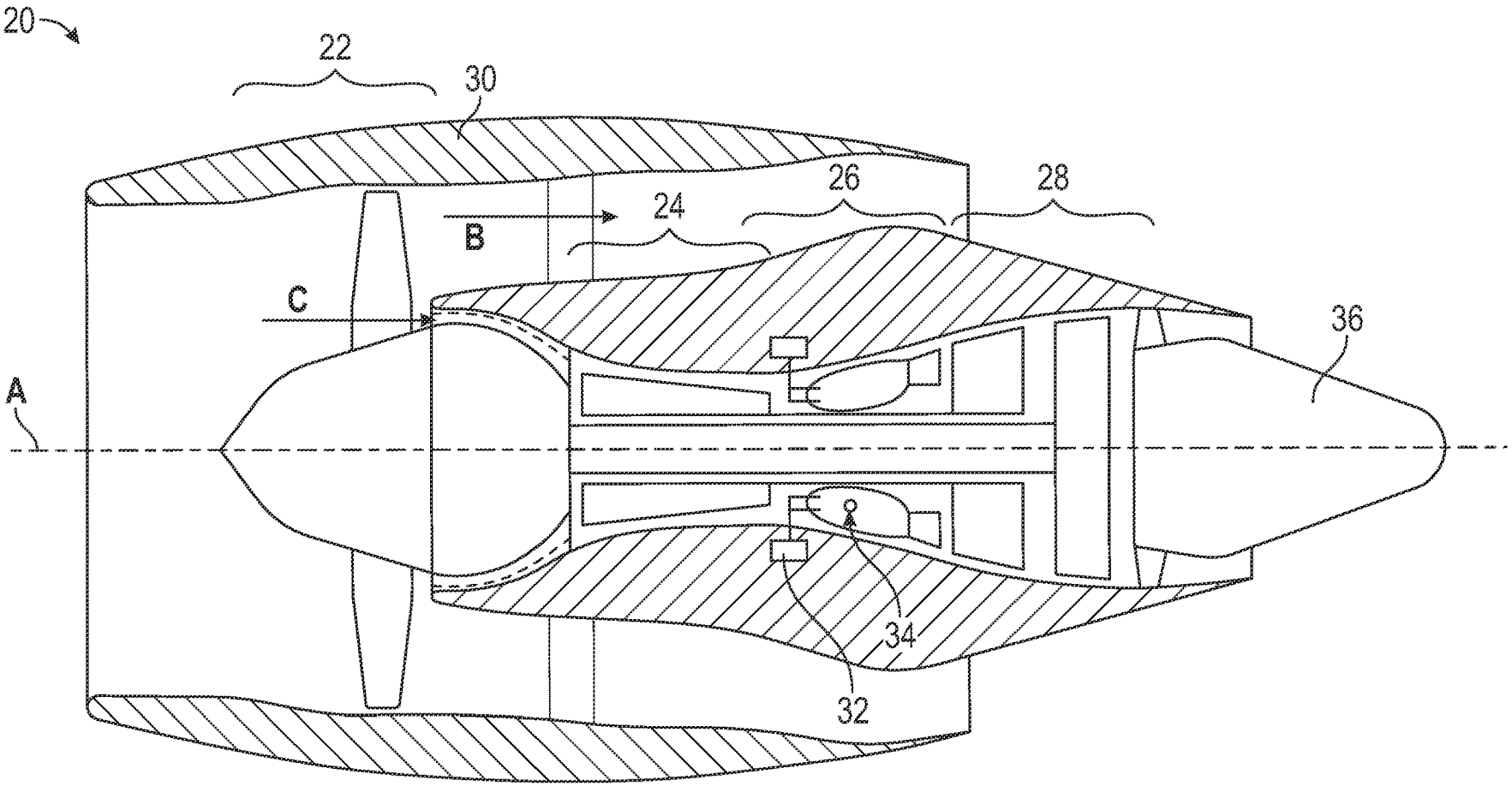
FIG. 1 is a schematic view of an example turbine engine.

FIG. 1 schematically illustrates a gas turbine engine 20. The example gas turbine engine 20 is a turbofan that generally incorporates a fan section 22, a compressor section 24, a combustor section 26 and a turbine section 28. The fan section 22 drives air along a bypass flow path B in a bypass duct defined within a nacelle 30. The compressor section 24 drives air along a core flow path C into the compressor section 24 for compression and communication into the combustor section 26. In the combustor section 26, the compressed air is mixed with fuel from a fuel system 32 and burnt to generate an exhaust gas flow that expands through the turbine section 28 and is exhausted through exhaust nozzle 36. Although depicted as a turbofan turbine engine in the disclosed non-limiting embodiment, it should be understood that the concepts described herein are not limited to use with turbofans as the teachings may be applied to other types of gas turbine engines.

Conventional hydrocarbon fuels are introduced into a combustor in a liquid form that is atomized to induce mixing with air. Alternative, non-carbon based fuels perform differently during combustion and therefore unconventional combustor/fuel injector arrangements are necessary to ensure a stable combustion process which delivers the desired turbine inlet temperature pattern, starting and durability while minimizing emissions. The disclosed example engine is designed to use gaseous hydrogen fuel. While it is conceptually possible to introduce hydrogen into the combustor in liquid form, hydrogen is more commonly introduced in a gas phase in gas turbine combustors in order to maintain stable combustion across the wide range of operating conditions required for an aviation gas turbine. As a gaseous fuel, hydrogen has a wider range of flammability and a higher flame velocity than conventional liquid fuels used in gas turbine engines, this results in changes in the flame pattern within the combustor which may influence the engine durability, starting, or emissions. Accordingly, the example combustor section 26 includes features tailored to operation using hydrogen fuel.

Figure 2:
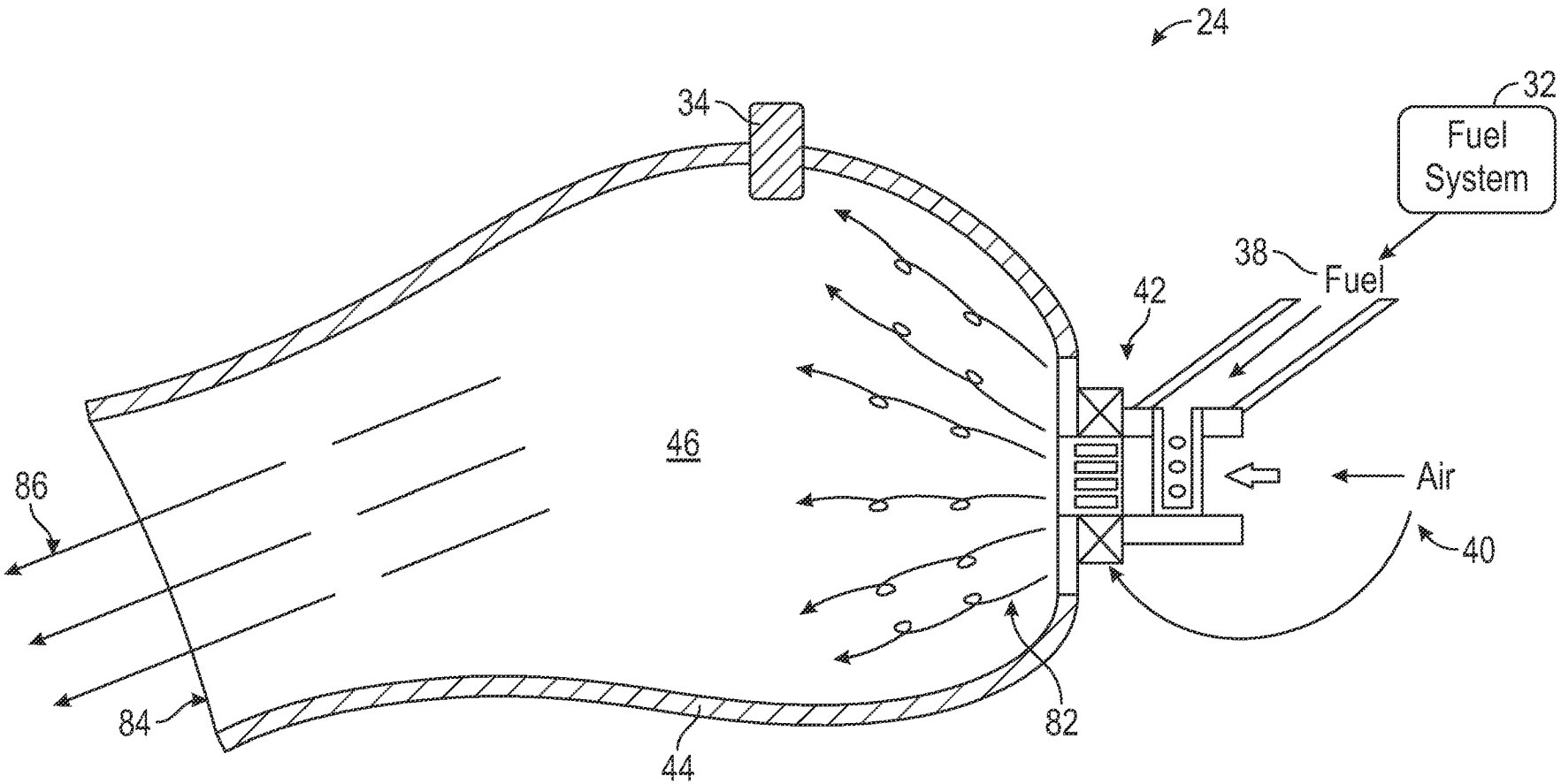
FIG. 2 is a simplified schematic view of an example combustor and fuel distributor.

Referring to FIG. 2, a fuel distribution system 35 and the combustor section 26 is shown schematically and includes a combustion chamber 46 defined within combustor walls 44. A fuel distributor 42 is mounted opposite a combustor outlet 84. The fuel distributor 42 mixes a gas fuel flow 38 with an airflow 40 prior to flowing into a combustion chamber 46. The ignited gas air mixture ignites to generate exhaust flow 86. The fuel distributor 42 further induces a swirling mixing flow 82 on the fuel air mixture as it is communicated into the combustion chamber 46. The air and fuel flows are tailored in conjunction with the combustor holes to provide stable combustion and minimized emissions across the range of engine operating conditions, as well as good starting when ignited by the igniter 34. One fuel distributor 42 is shown by way of example, but more than one fuel distributor 42 would be utilized and spaced apart to distribute fuel and air around the circumference of the engine.

Figure 3:
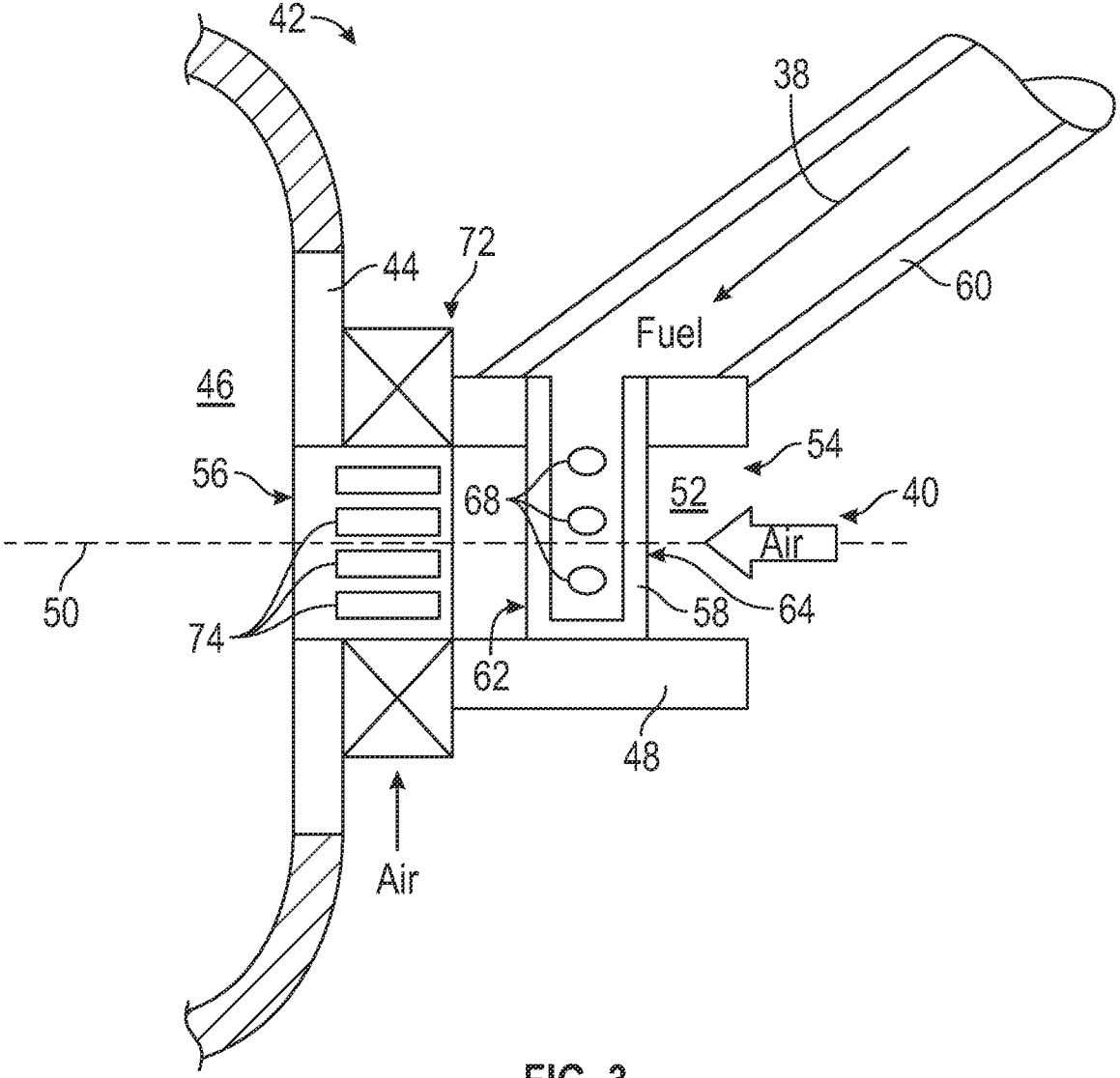
FIG. 3 is an enlarged schematic view of an example fuel distribution nozzle. a wall of the converging duct of an example thermal compressor embodiment.

Referring to FIG. 3, the example fuel distributor 42 is shown in an enlarged view and includes a fuel injection conduit 48 defining a mixing chamber 52 defined along a longitudinal axis 50. The mixing chamber 52 extends along the axis 50 between an inlet 54 for compressed airflow 40 and an exit opening 56 into the combustion chamber 46. A conduit is defined by one or more structures that together convey a fluid from one point to another. For example, a conduit conveying fluid from point A to point B may include one of, or a combination of: a conduit, an aperture defined through a part of an engine, a filter, a pump, and so on, depending on the application.

Figure 4:
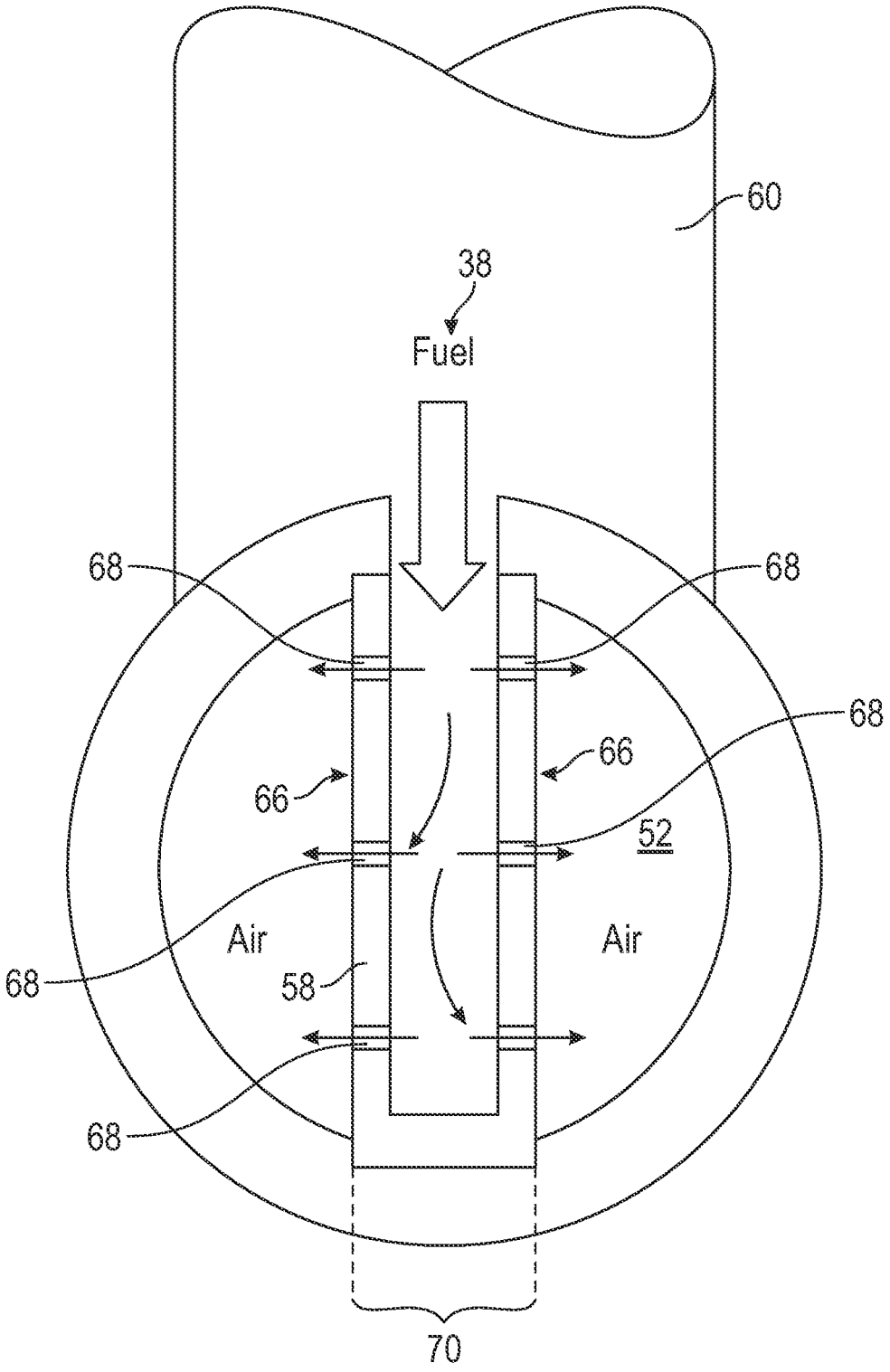
FIG. 4 is a cross-sectional view of the example fuel distributor.

Referring to FIG. 4, with continued reference to FIG. 3, a fuel passage 60 provides the gas fuel flow 38 to a fuel distributor 58. The fuel distributor 58 includes side surfaces 66 that extend between a downstream side 62 and an upstream side 64. Fuel openings 68 are provided on each of the side surfaces 66 and communicate a fuel flow into the mixing chamber 52. Although a certain number and shape of fuel openings 68 are shown by way of example, other shapes and numbers of fuel openings 68 could also be utilized and are within the contemplation of this disclosure.

In one disclosed example embodiment, the distributor 58 is disposed in a central region 70 of the mixing chamber 52 as is shown best in FIG. 4. The distributor 58 is further spaced axially apart from the exit opening to provide sufficient space for mixing of air and fuel. The fuel injection ports 68 are further provided in an orientation that is normal to the flow of air 40 through the air conduit 48 to encourage mixing.

Although the example fuel distributor 42 is shown with a single distributor 58, more than one distributor could be utilized within the scope and contemplation of this disclosure. Additionally, one fuel passage 60 is shown for providing the fuel flow, but additional passages could be utilized and remain within the contemplation of this disclosure.

In the disclosed embodiment, the air conduit 48 and mixing chamber 52 are substantially circular in cross-section. However, the air conduit 48 may be configured with other cross-sectional shapes. The shape of the air conduit 48, fuel distributor 58 and the mixing chamber 52 are designed to ensure both good mixing and velocities high enough to prevent burning of the hydrogen within the mixing chamber.

The mixing chamber 52 exit opening 56 is downstream of a secondary air inlet provided as a disclosed swirler 72. The swirler 72 includes a plurality of air openings 74 that are orientated to induce a swirling component into the fuel/air mixture prior to being communicated into the combustion chamber 46. The air swirler 72 may also be configured to introduce a swirling component into the fuel/air mixture immediately as it enters the combustion chamber 46. The air swirler 72 is designed in conjunction with the fuel mixing and the combustor in order to obtain the desired distribution of the fuel/air mixture and heat release within the combustion chamber 46.

Figure 5:
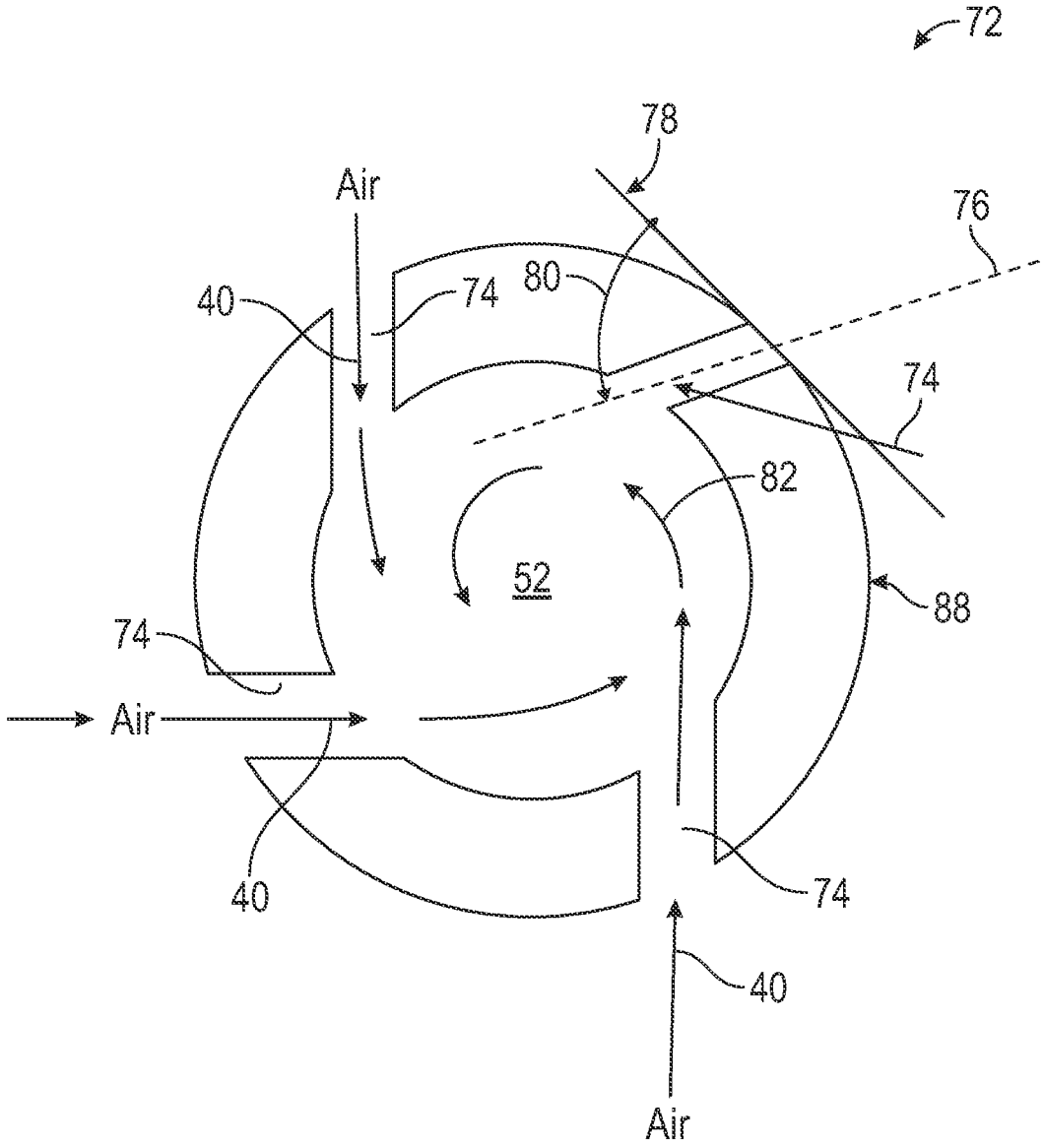
FIG. 5 is a cross-sectional view through a portion of the example fuel distributor.

Referring to FIG. 5, with continued reference to FIG. 3, the swirler 72 includes the air passages 74 that are orientated to introduce air flow such that it swirls about the mixing chamber 52. Each of the air passages 74 are disposed about a passage axis indicated at 76. The passage axis 76 is disposed at a non-normal angle 80 relative to a line 78 tangent to an outer surface 88 of the swirler 72. As appreciated, the size, shape and number of each of the air passages 74 may be different than shown to tailor air flow and the induced swirl to application specific needs.

Figure 6:
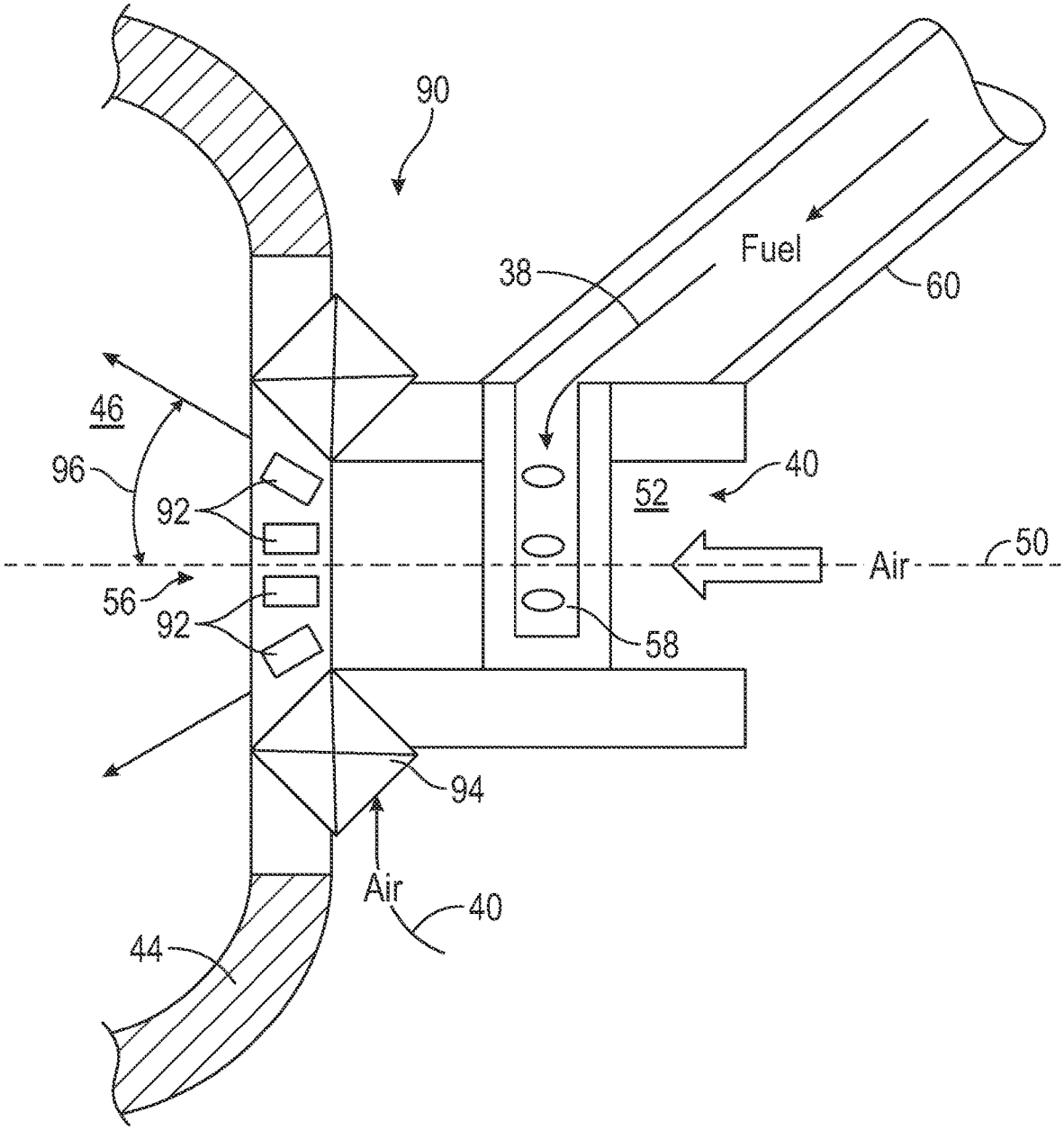
FIG. 6 is a cross-sectional view of another example fuel distributor.

Referring to FIG. 6, another example fuel distributor embodiment is indicated at 90 and includes a swirler 94 that introduces a second air flow into the combustor chamber 46 proximate the exit openings 56. The example swirler 94 injects the second air flow through air openings 92 at an angle 96 relative to the central axis 50 in additional to the radial flow component shown in FIG. 5. The additional axial component further induces mixing of the fuel air mixture and propels that mixture into the combustion chamber 46 away from the exit opening 56.

Figure 7:
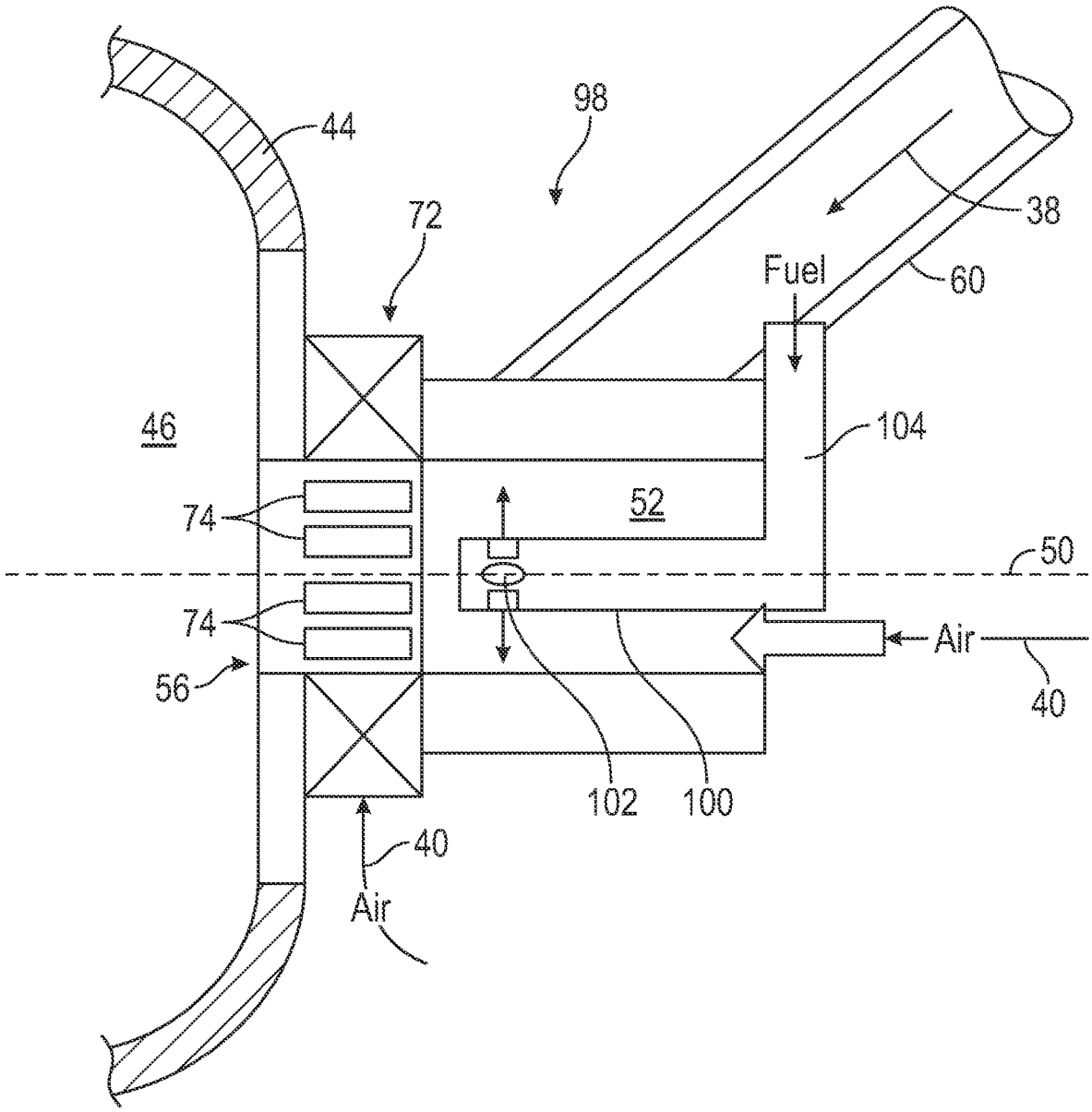
FIG. 7 is a cross-sectional view of another example fuel distributor.

Referring to FIG. 7, another example fuel distributor embodiment is indicated at 98 and includes a fuel manifold 100 that extends along the axis 50 toward the exit opening 56. The manifold 100 provides for a fuel flow axially from an inlet conduit 104 in communication with the fuel supply conduit 60. The manifold 100 includes a plurality of fuel openings 102 that inject fuel into the mixing chamber transverse to flow of inlet airflow 40 along the axis 50. The manifold 100 provides for targeted introduction into the mixing chamber 52 at a desired location along the axis 50 and proximate the exit opening 56.

Figure 8:
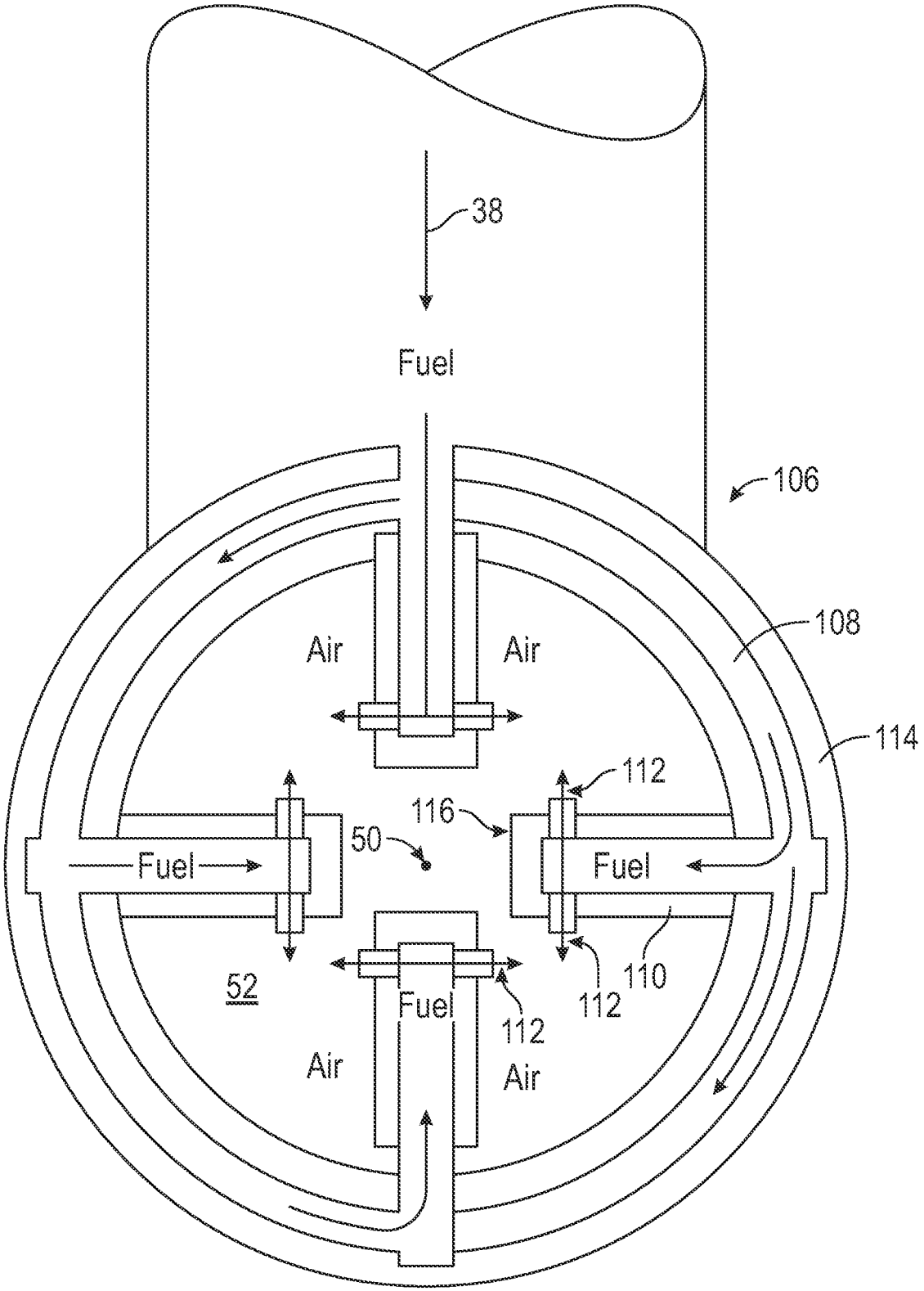
FIG. 8 is a cross-sectional view of an example fuel manifold embodiment.

Referring to FIG. 8, another example fuel manifold 106 is shown and provides for introduction of fuel 38 radially inward from an annular conduit 108. The fuel manifold 106 includes radially inward extending arms 110 with fuel openings 112. The fuel openings 112 are disposed at a radially inward end 116 of each arm 110. The arms 110 extend inward from a housing 114 containing the annular conduit 108 toward the central axis 50. The arms 110 terminate at the radially inward end 116. The fuel openings 112 are disposed proximate the radially inward end 116 to introduce fuel flow 38 at an interior of the mixing chamber 52 to induce mixing. The example arms 110 may be spaced any axial distance form the exit opening that provides a desired duration for mixing.

The example fuel distributors 42, 90 and 98 is operated at a stochiometric range of between 0.5 and 2. The air passages 74 of the swirler 72 and the size and shape of the mixing chamber 52 and fuel distributor 58 may be adjusted to provide the desired stochiometric mixture of fuel and air communicated into the combustion chamber 46.

The example fuel distributors 42, 90 and 98 provide mixing of air and gaseous fuel prior to being introduced into the combustion chamber 46. Additionally, the example fuel distributors 42, 90 and 98 induce a swirling flow in the fuel air mixture to aid in distribution upon entering the combustion chamber 46 to improve combustion operation and efficiency.

A fuel mixture distribution system 35 for a turbine engine assembly 20 according to an exemplary embodiment of this disclosure, among other possible things includes a combustor 26 that includes a wall 44 that defines a combustion chamber 46, a fuel mixture distributor 42 that includes an air conduit 48 that defines a mixing chamber that extends between an inlet to an exit opening 56 to the combustion chamber 46, the air conduit 48 shape is defined to achieve the desired mixing and prevent flashback at all operating conditions, and a fuel distributor 42 extends into the mixing chamber 52 at a location upstream of the exit opening 56. The fuel distributor 42 includes a plurality of fuel openings 68 where a fuel flow 38 is communicated and mixed with an airflow 40 passing through the mixing chamber 52.

In a further embodiment of the foregoing, the fuel mixture distributor 42 further includes a secondary air inlet 72 that is disposed within the air conduit 48 proximate the wall 44.

In a further embodiment of any of the foregoing, the fuel distributor 42 is spaced upstream from the secondary air inlet 72.

In a further embodiment of any of the foregoing, the secondary air inlet 72 includes a plurality of air passages 74 that are disposed about a periphery of the air conduit 48. The air passages 74 include a passage axis 76 that is disposed at a non-normal angle relative to a line 78 that is tangent with the periphery of the air conduit 48 for inducing a swirling secondary airflow of a fuel air mixture that is communicated through the exit into the combustion chamber 46.

In a further embodiment of any of the foregoing, the plurality of air passages 74 are disposed at an angle 96 relative to a central axis 50 that provides an axially directed flow component to the fuel air mixture.

In a further embodiment of any of the foregoing, the fuel distributor 42 is centered within the air conduit 48 relative to a cross-section of the air conduit 48.

In a further embodiment of any of the foregoing, the fuel distributor 42 includes side surfaces 66 that extend between an upstream side 64 and a downstream side 62. The plurality of fuel openings 68 are disposed on one or both of the side surfaces 66, so as to inject the fuel perpendicularly to the direction of air flow.

In a further embodiment of any of the foregoing, the fuel distributor 42 extends along a central axis 50 toward the exit opening 56.

In a further embodiment of any of the foregoing, the fuel distributor 42 includes a plurality of inward extending arms 110 that extend inward toward a central axis 50.

In a further embodiment of any of the foregoing, the air conduit 48 includes a curvilinear shape.

In a further embodiment of any of the foregoing, the air conduit 48 includes a generally oval cross-section transverse to the axis 50.

In a further embodiment of any of the foregoing, the air conduit 48 includes a uniform cross-section transverse to the axis 50 between the inlet 54 and the exit opening 56.

A combustor 26 for a turbine engine 20 according to another exemplary embodiment of this disclosure, among other possible things includes a combustor wall 44 that defines a combustion chamber 46, and at least one fuel mixture distributor 42 that is disposed at an end of the combustion chamber 46. The fuel mixture distributor 42 includes an air conduit 48 that defines a mixing chamber 52 that extends between an inlet 54 and an exit opening 56 to the combustion chamber 46. The air conduit 48 shape is defined to achieve the desired mixing and prevent flashback at all operating conditions. A fuel distributor 42 extends into the mixing chamber 52 at a location upstream of the exit opening 56. The fuel distributor 42 includes a plurality of fuel openings 68 where a fuel flow 38 is communicated and mixed with air in the mixing chamber 52. A secondary air inlet 72 where a secondary airflow 42 is introduced into the air conduit 48 proximate the exit opening 56 induces swirling component into a fuel air mixture communicated into the combustion chamber 46.

In a further embodiment of the foregoing, the secondary air inlet 72 includes a plurality of air passages 74 that are disposed about a periphery of the air conduit 48. The air passages 74 include a passage axis 76 that is disposed at a non-normal angle relative to a line 78 that is tangent with the periphery of the air conduit 48 for inducing a swirling secondary airflow of a fuel air mixture 38 that is communicated through the exit 56 into the combustion chamber 46.

In a further embodiment of any of the foregoing, the combustor 26 for a turbine engine 20 includes a fuel supply conduit 60 where a fuel in gas phase is communicated to the fuel distributor 42.

In a further embodiment of any of the foregoing, the fuel distributor 42 includes side surfaces 66 that extend parallel to the axis 50 and are disposed between an upstream side 64 and a downstream side 62. The plurality of fuel openings 68 are disposed on one or both of the side surfaces 66.

In a further embodiment of any of the foregoing, the fuel distributor 42 includes an open space that is disposed between the side surfaces 66.

A turbine engine assembly 20 according to another exemplary embodiment of this disclosure, among other possible things includes a compressor section 24 and turbine section that are disposed in flow series along an engine longitudinal axis, a combustor 26 that is disposed between the compressor section 24 and turbine section 28, the combustor 26 includes walls 44 that define a combustion chamber 46. At least one fuel mixture distributor is disposed at an end of the combustion chamber 46, the fuel mixture distributor 42 includes an air conduit 48 that defines a mixing chamber 52 that extends through the wall 44 along an axis 50 between an inlet 54 to an exit opening 56 to the combustion chamber 46. The air conduit 48 shape is defined to achieve the desired mixing and prevent flashback at all operating conditions. A fuel distributor 42 extends into the mixing chamber 52 at a location before the exit 56. The fuel distributor 42 includes a plurality of fuel openings 112 where a fuel flow 38 is communicated to a central region 70 within the mixing chamber 52, and a secondary air inlet 72 where a secondary airflow is introduced into the air conduit 48 proximate the exit opening 56 induces swirling component into a fuel air mixture 38 that is communicated into the combustion chamber 46, and a fuel system 32 communicates a hydrogen fuel in a gaseous phase to the fuel mixture distributor 42.

In a further embodiment of the foregoing, wherein the secondary air inlet 72 comprises a plurality of air passages 74 that are disposed about a periphery of the air conduit 48. The air passages 74 include a passage axis 76 that is disposed at a non-normal angle relative to a line 78 that is tangent with the periphery of the air conduit 48 for inducing a swirling secondary airflow of a fuel air mixture that is communicated through the exit 56 into the combustion chamber 46.

In a further embodiment of any of the foregoing, the fuel distributor 42 includes side surfaces 66 that extend parallel to the axis 50 and are disposed between an upstream side 64 and a downstream side 62. The plurality of fuel openings 112 are disposed on one or both of the side surfaces 66.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A fuel mixture distribution system for a turbine engine assembly comprising:

a combustor including a wall defining a combustion chamber;

a fuel mixture distributor including:

an air conduit defining a mixing chamber extending along a central longitudinal axis between an inlet and an exit opening that opens to the combustion chamber, the air conduit shape defined to provide mixing of fuel and air and for preventing flashback at all operating conditions; and a fuel distributor including a fuel inlet extending radially inward through an outermost wall of the air conduit and transverse to the central longitudinal axis through the air conduit at a location between the inlet and the exit opening into the mixing chamber, the fuel distributor including side surfaces that extend between a downstream side and an upstream side, and a plurality of fuel openings through each of the side surfaces that receive a fuel flow from the inlet, the fuel flow from the plurality of fuel openings is communicated and mixed with an airflow passing through the mixing chamber; and a secondary air inlet through the outermost wall of the air conduit and spaced downstream of the fuel distributor and proximate the wall of the combustor.

2. The fuel mixture distribution system as recited in claim 1, wherein the secondary air inlet comprises a plurality of air passages disposed about a periphery of the air conduit, each air passage of the plurality air passages including a passage axis that is disposed at a non-normal angle relative to a line tangent with the periphery of the air conduit for inducing a swirling secondary airflow of a fuel air mixture communicated through the exit into the combustion chamber.

3. The fuel mixture distribution system as recited in claim 2, wherein the plurality of air passages are disposed at an angle relative to the central longitudinal axis that provides an axially directed flow component to the fuel air mixture.

4. The fuel mixture distribution system as recited in claim 1, wherein the fuel distributor includes a plurality of radially inward extending arms that extend inward toward the central longitudinal axis.

5. The fuel mixture distribution system as recited in claim 1, wherein the air conduit comprises a curvilinear shape.

6. The fuel mixture distribution system as recited in claim 1, wherein the air conduit includes a generally oval cross-section transverse to the axis.

7. The fuel mixture distribution system as recited in claim 1, wherein the air conduit comprises a uniform cross-section transverse to the axis between the inlet and the exit opening.

8. A combustor for a turbine engine comprising:

a combustor wall defining a combustion chamber; and at least one fuel mixture distributor disposed at an end of the combustion chamber, the fuel mixture distributor including:

an air conduit defining a mixing chamber extending along a central longitudinal axis between an inlet and an exit opening that opens to the combustion chamber, the air conduit shape defined to provide mixing of fuel and air and for preventing flashback at all operating conditions;

a fuel distributor including a fuel inlet transverse to the central longitudinal axis and extending radially through an outermost wall of the air conduit into the mixing chamber and to an inner surface of the air conduit at a location between the inlet and the exit opening, the fuel distributor including a plurality of fuel openings where a fuel flow is communicated and mixed with air in the mixing chamber; and a secondary air inlet through the outermost wall of the air conduit where a secondary airflow is introduced into the air conduit downstream from the fuel distributor and proximate the exit opening for inducing a swirling component into a fuel air mixture communicated into the combustion chamber.

9. The combustor for the turbine engine as recited in claim 8, wherein the secondary air inlet comprises a plurality of air passages disposed about a periphery of the air conduit, each air passage of the plurality of air passages including a passage axis that is disposed at a non-normal angle relative to a line tangent with the periphery of the air conduit for inducing a swirling secondary airflow of a fuel air mixture communicated through the exit into the combustion chamber.

10. The combustor for the turbine engine as recited in claim 8, including a fuel supply conduit where the fuel flow in a gas phase is communicated to the fuel distributor.

11. The combustor for the turbine engine as recited in claim 10, wherein the fuel distributor includes side surfaces extending parallel to the central longitudinal axis from the outermost wall of the air conduit to an inner surface of the air conduit and disposed between an upstream side and a downstream side, wherein the plurality of fuel openings are disposed on one or both of the side surfaces.

12. The combustor for the turbine engine as recited in claim 11, wherein the fuel distributor includes an open space disposed between the side surfaces.

13. A turbine engine assembly comprising;

a compressor section and turbine section disposed in flow series along an engine axis;

a combustor disposed between the compressor section and turbine section, the combustor including walls defining a combustion chamber;

at least one fuel mixture distributor disposed at an end of the combustion chamber, the fuel mixture distributor including:

an air conduit defining a mixing chamber extending through one of the walls of the combustor along a longitudinal axis between an inlet to an exit opening that opens to the combustion chamber, the air conduit shape defined to provide mixing of fuel and air and for preventing flashback at all operating conditions;

a fuel distributor extending radially inward through an outermost wall of the air conduit into the mixing chamber at a location between the inlet and the exit opening, the fuel distributor including a plurality of fuel openings where a fuel flow is communicated to a central region within the mixing chamber; and a secondary air inlet through the outermost wall of the air conduit and downstream of the fuel distributor where a secondary airflow is introduced into the air conduit downstream of the fuel distributor and proximate the exit opening for inducing a swirling component into a fuel air mixture communicated into the combustion chamber; and a fuel system communicating a hydrogen fuel in a gaseous phase to the fuel mixture distributor.

14. The turbine engine assembly as recited in claim 13, wherein the secondary air inlet comprises a plurality of air passages disposed about a periphery of the air conduit, each of the air passages of the plurality of air passages including a passage axis that is disposed at a non-normal angle relative to a line tangent with the periphery of the air conduit for inducing a swirling secondary airflow of the fuel air mixture communicated through the exit into the combustion chamber.

15. The turbine engine assembly as recited in claim 14, wherein the fuel distributor includes side surfaces extending parallel to the longitudinal axis through the outermost wall of the air conduit do an inner surface of the air conduit and disposed between an upstream side and a downstream side, wherein the plurality of fuel openings are disposed on one or both of the side surfaces.

* * * * *